United States Patent [19]

Stoehr

[11] 4,412,443

[45] Nov. 1, 1983

[54] ROLLER FORMING MACHINE WITH LENGTHWISE ADJUSTABLE HEADS

[75] Inventor: Herbert M. Stoehr, New Berlin, Wis.

[73] Assignee: Artos Engineering Company, New Berlin, Wis.

[21] Appl. No.: 288,468

[22] Filed: Jul. 30, 1981

[51] Int. Cl.[3] ..... B21D 5/08

[52] U.S. Cl. ..... 72/181; 72/234; 72/249; 72/449; 74/450

[58] Field of Search ..... 72/249, 234, 226, 237, 72/181, 449; 74/450, 451, 439

[56] References Cited

U.S. PATENT DOCUMENTS

| | | | |
|---|---|---|---|
| 750,910 | 2/1904 | Townsend | 74/450 |
| 762,225 | 6/1904 | Beckett | 74/450 |
| 836,047 | 11/1906 | Mountain | 72/249 |
| 1,039,375 | 9/1912 | Freeland | 74/450 |
| 1,792,122 | 2/1931 | Rafter | 72/249 |
| 2,561,634 | 7/1951 | Picton | 72/249 |
| 2,683,380 | 7/1954 | Hutton | 74/450 |
| 3,319,413 | 5/1967 | Costner | 74/450 |
| 3,867,826 | 2/1975 | Noé | 72/249 |

FOREIGN PATENT DOCUMENTS

| | | | |
|---|---|---|---|
| 612214 | 1/1961 | Canada | 74/450 |
| 839702 | 6/1960 | United Kingdom | 74/450 |

*Primary Examiner*—Daniel C. Crane
*Attorney, Agent, or Firm*—James E. Nilles

[57] ABSTRACT

At least one head on a roller forming machine can be fixed at any of several different positions along the length of its frame. A line shaft extending along the frame has a bevel pinion for each head, meshing with a driven bevel gear on the head, to drive forming rollers on the head. Each bevel pinion comprises a front two-part pinion member and a rear two-part collar member. Each two-part member has a coaxial bore through it, and its two parts, held together by clamping screws, separate on a plane containing its axis. The bore through the pinion member has a sliding fit on the line shaft, that through the collar member has an interference fit, and the opposing surfaces of the collar member parts are taken down so that the collar member tightly clamps the line shaft. In the front surface of the collar member and the opposing rear surface of the pinion member are radially extending keyway grooves in which keys are received whereby the collar member constrains the pinion member to rotate with the line shaft.

9 Claims, 12 Drawing Figures

ROLLER FORMING MACHINE WITH LENGTHWISE ADJUSTABLE HEADS

FIELD OF THE INVENTION

This invention relates to roller forming machines wherein an elongated metal workpiece is moved lengthwise through successive pairs of forming rollers to be worked to a desired configuration in cross-section; and the invention is more particularly concerned with a roller forming machine having an elongated frame that supports a plurality of forming heads, each comprising a pair of roller shafts on which forming rollers are carried, wherein at least one of said forming heads can be positioned at any selected one of a plurality of alternative locations along the length of the frame and can have its roller shafts drivingly connected with a line shaft that extends along one side of the frame.

BACKGROUND OF THE PRIOR ART

A roller forming machine of the general type to which this invention relates comprises an elongated frame or table on which there are mounted a plurality of forming heads, each comprising a pair of parallel roller shafts that extend transversely to the table. A pair of rollers mounted on the roller shafts of each head have mating profiles and engage opposite sides of an elongated metal workpiece to form it to a configuration in cross section that substantially corresponds to the roller profiles. Successive sets of rollers engage the workpiece to effect progressive modification of its shape until it is worked to a desired cross-section. The roller shafts of each head are rotatably driven in opposite directions so that as the pair of rollers form the workpiece they also cooperate to advance it lengthwise from one forming head to another.

Since a workpiece undergoes a change of cross-section shape at each engagement by cooperating forming rollers, the portion of the workpiece that extends from one such roller pair to another is subjected to a certain amount of stress. In prior roller forming machines, the several forming heads were fixed to the frame at uniformly spaced intervals along it, and it sometimes happened that the fixed distance between a pair of adjacent forming heads was too short for the change in form that would have been imposed upon the workpiece in passing from one to the other of them. In that case it was necessary to remove the rollers from one forming head so that there was a greater length of workpiece between active roller pairs. Often there were two or more forming heads along the length of the frame that were idled in this manner, and frequently, on such occasions, the remaining active forming heads on the machine were too few in number for the required forming operation, so that another complete forming machine had to be used to provide the needed total number of operating forming heads. As a rule, only one or a few of the forming heads on the second machine would be active and the rest would be idle.

What this meant, in practice, was that a shop wanting to be able to handle a variety of roller forming jobs had to have two standard roller forming machines aligned in tandem; whereas the real need was for only one machine with an increased distance between certain of its forming heads and a correspondingly increased frame length.

It was probably apparent that the efficiency and versatility of the roller forming machines could be materially improved if they were provided with forming heads that were adjustable to different positions along the length of the machine frame. But heretofore such adjustability would have given rise to certain problems that had no obvious solution.

The several roller shafts of a roller forming machine should rotate in unison, and for this reason, and as a matter of efficiency, all roller shafts should be driven from a common power source. Drive chains have been used on some roller forming machines, but a chain drive tends toward a jerky or fluctuating torque delivery and is in other respects undesirable in a roller forming machine. The preferred drive mechanism comprises a rotatable power shaft that has gear connections with the roller shafts of the several forming heads. In one common prior arrangement, each forming head carried a short segment of drive shaft that projected forwardly and rearwardly from it, and the shaft segments of adjacent forming heads along the frame were connected by modular lengths of shaft that were key-connected at their opposite ends to the respective shaft segments on the forming heads. To maintain concentricity of the numerous shaft elements, each forming head had bearings in which its shaft segment was journaled, and each modular length of shaft had to extend through a bearing that was carried by a fixed bearing support on the machine frame. Owing to its many bearings, shaft elements and shaft element couplers, such a prior torque transmission system for roller forming machines was not only complicated and expensive but was also, from a practical standpoint, quite inflexible in that it could not readily accommodate adjustable shifting of the forming heads to different locations along the frame.

It can be seen that the provision of a roller forming machine with one or more forming heads positionable at different locations along the length of the machine frame presents the basic problem of providing a simple, inexpensive and versatile mechanism or structure for transmitting torque from a motor to the roller shafts of each such forming head at any location at which the forming head may be positioned.

The present invention contemplates, as a replacement for the heretofore-conventional shaft made up of numerous shaft elements and couplers, a rotatable line shaft which extends along substantially the full length of the machine frame and which consists of one or a few long shaft elements. Rotation of the line shaft is transmitted to the roller shafts on the several forming heads through bevel pinions on the line shaft, one for each forming head, each meshing with a bevel gear on its forming head. With this arrangement, in order for a forming head to be adjustable to different locations along the length of the line shaft, the bevel pinion for that forming head must obviously be correspondingly adjustable along the line shaft. However, such adjustability of the bevel pinions poses problems which will be recognized by those skilled in the art.

Each bevel pinion, at any location at which it may be established, must obviously have a good torque transmitting connection with the line shaft, capable of transferring a substantial amount of power from the line shaft to the driven bevel gear. A keyed connection between the shaft and the bevel pinion is out of the question, not only because of the difficulty in cutting a key slot along substantially the full length of a long shaft but, more important, because the presence of the slot in the rotating shaft would be destructive to any bearing through which the shaft extended. Another consideration that must be kept in mind is that bevel pinions are subject to damage and breakage from time to time, and replacement of a bevel pinion should not require that the long shaft be slid through the damaged bevel pinion and all other pinions and bearings at one axial side of it.

A further complicating factor is that each bevel pinion on the line shaft, in transferring torque to its driven bevel gear, imposes a substantially high lateral force upon the line shaft, and to prevent bowing of the line shaft in response to such force, the shaft should be rigidly supported adjacent to each bevel pinion. The means for affording such support to the line shaft should not interfere with shifting of forming heads from one location to another along the length of that shaft nor with the corresponding shifting of bevel pinions for the respective forming heads.

SUMMARY OF THE INVENTION

With the above-stated considerations in mind, the general object of this invention is to provide a simple, practical and inexpensive roll forming machine having forming heads that can be positioned at any of various locations along the length of the machine frame and having a line shaft that extends along substantially the full length of the frame and comprises one or a few long shaft elements, wherein the roller shafts of each forming head are driven from a bevel gear on the forming head that meshes with a bevel pinion on the line shaft, and wherein the bevel pinion for each forming head is readily adjustable along the length of the line shaft to accommodate any of the different locations at which the forming head may be established.

Another and more specific object of the invention is to provide a bevel pinion whereby torque can be transmitted from a line shaft to a meshing bevel gear and which is very readily adjustable from place to place along the length of the line shaft with assurance of a good torque transmitting connection between it and the line shaft at every such location, said bevel pinion having the further advantage that it can be readily removed from the line shaft without the need for relatively axial sliding motion between it and the shaft.

A further specific object of this invention is to provide a lengthwise-split bevel pinion which can have a secure coaxial clamping connection to a shaft at any selected location along the length thereof, to be constrained to rotation therewith, said bevel pinion being formed in two parts that are separable on a plane containing its axis so as to be readily removed from the shaft but nevertheless having teeth which are regularly spaced and completely uniform, including the teeth adjacent to said plane at opposite sides thereof.

It can be seen that the ultimate object of this invention is to provide a roller forming machine which is substantially more versatile than comparable machines heretofore available and whereby a wide variety of forming operations can be accomplished with a relatively modest investment inasmuch as a single machine of this invention, having a frame somewhat longer than the frames of heretofore conventional machines and having forming heads adjustable along that frame, can perform many forming operations for which two prior machines would have been needed.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
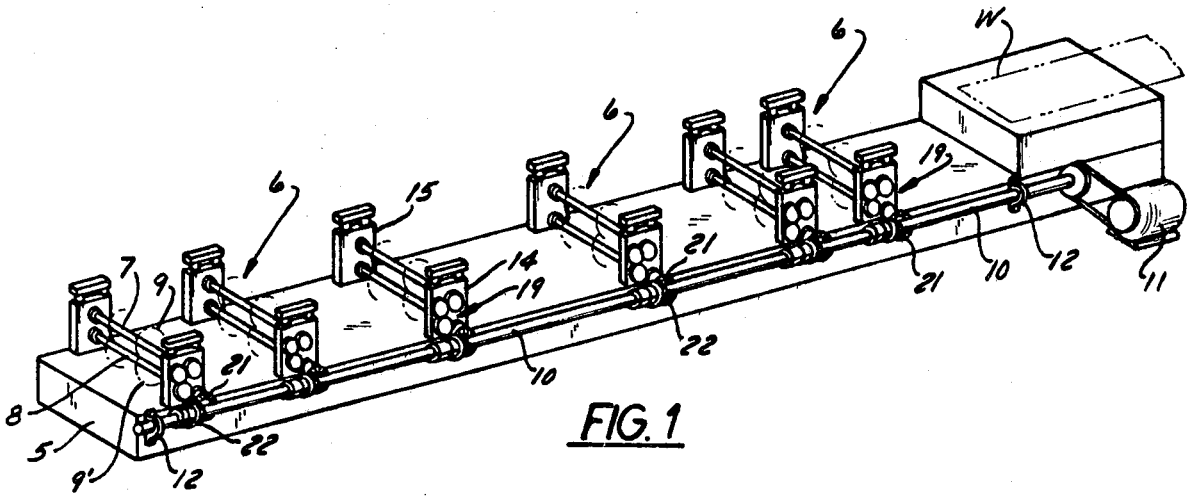
FIG. 1 is a somewhat simplified perspective view of a roller forming machine embodying the principles of this invention.
Figure 8:
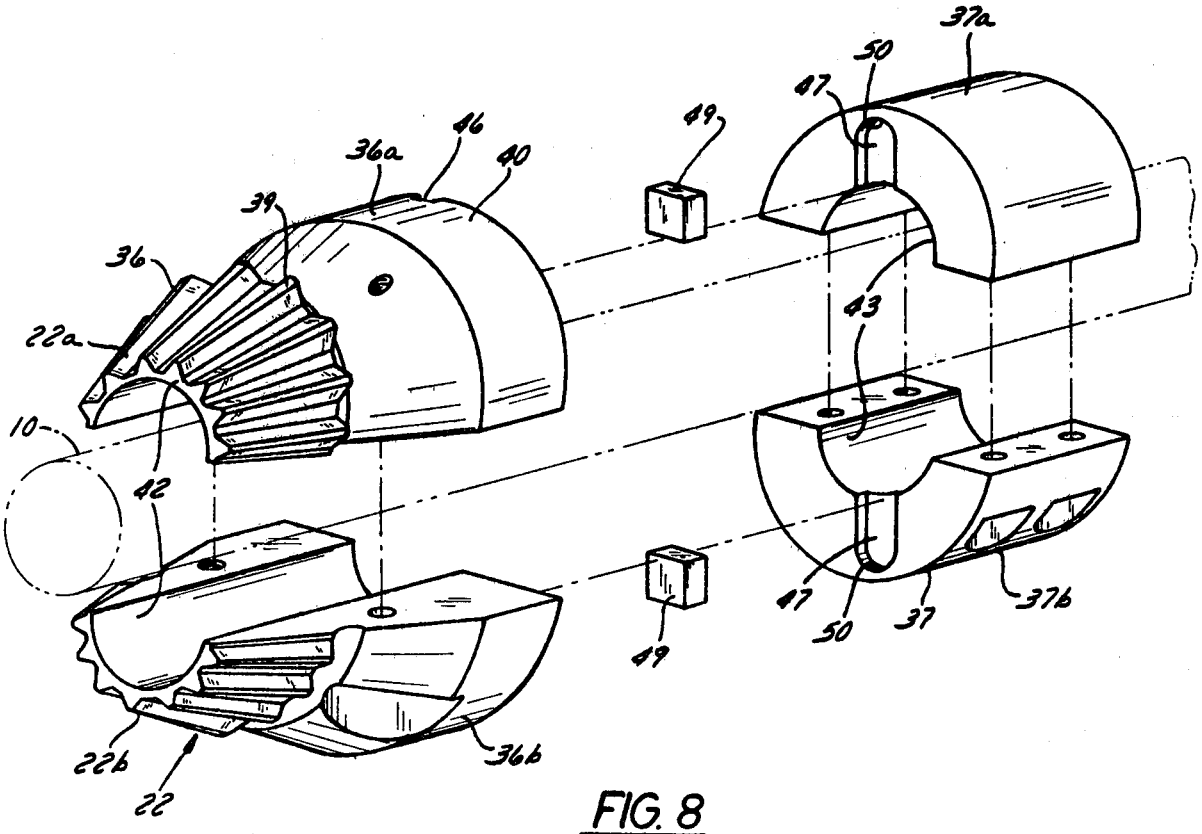
FIG. 8 is a large-scale disassembled perspective view of one of the bevel pinions on the line shaft whereby the roller shafts of a forming head are driven.
Figure 3:
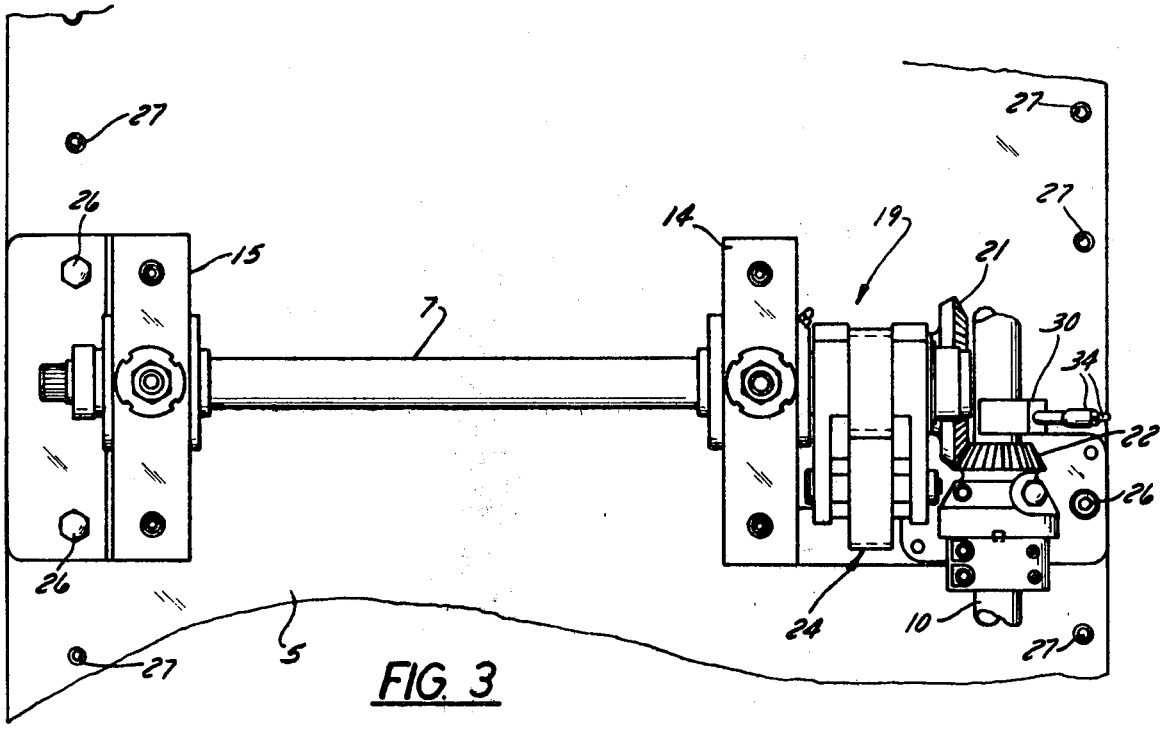
FIG. 3 is a top view of the forming head shown in FIG. 2.
Figure 2:
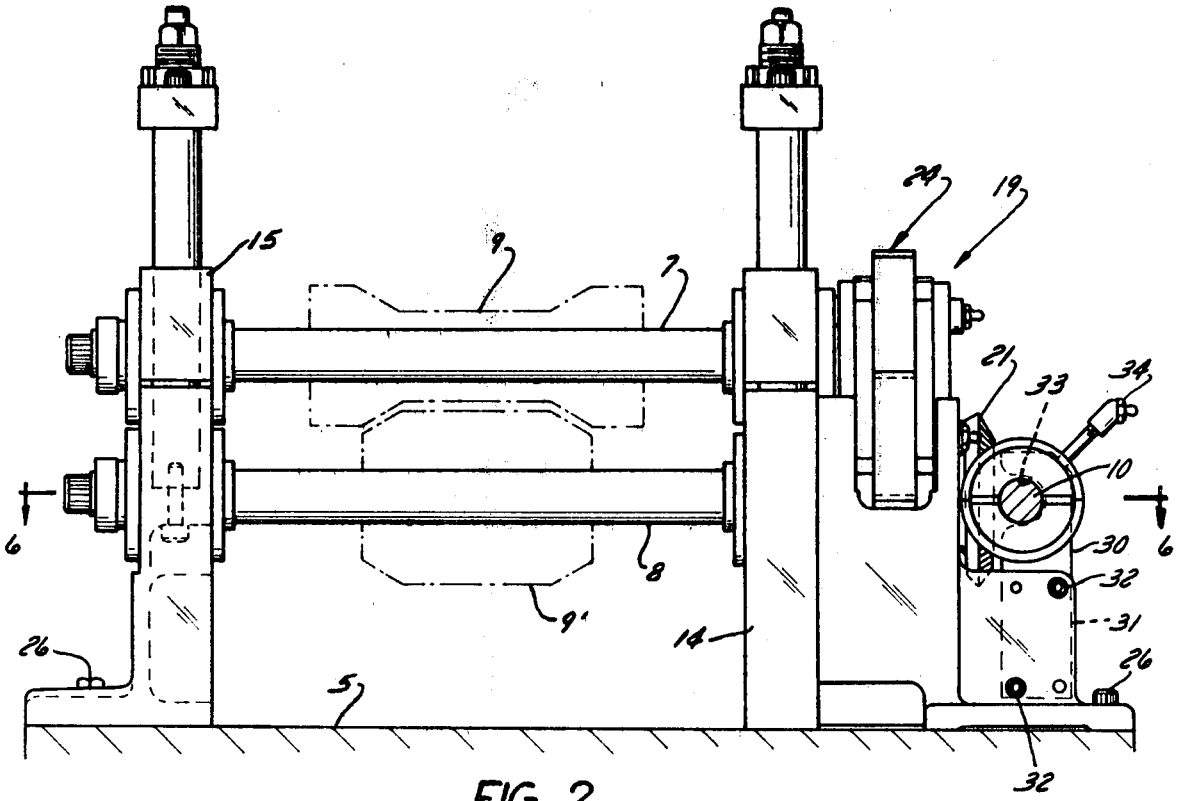
FIG. 2 is a view in elevation, seen in the direction of workpiece travel, of one of the forming heads of the roller forming machine of this invention.
Figure 7:
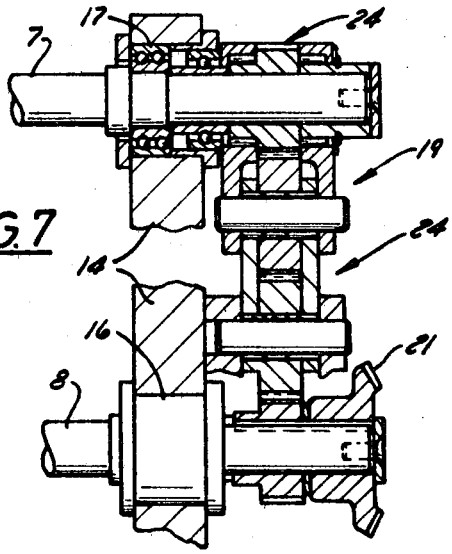
FIG. 7 is a sectional view through the transmission means of a forming head whereby its roller shafts are driven from the line shaft.
Figure 6:
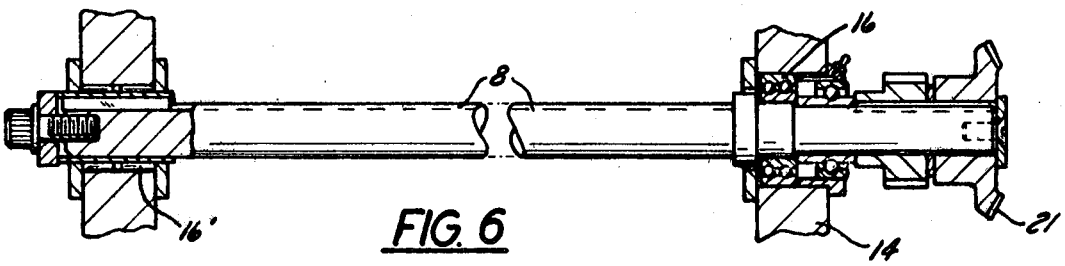
FIG. 6 is a fragmentary view in section, taken on the plane of the line 6—6 in FIG. 2.
Figure 5:
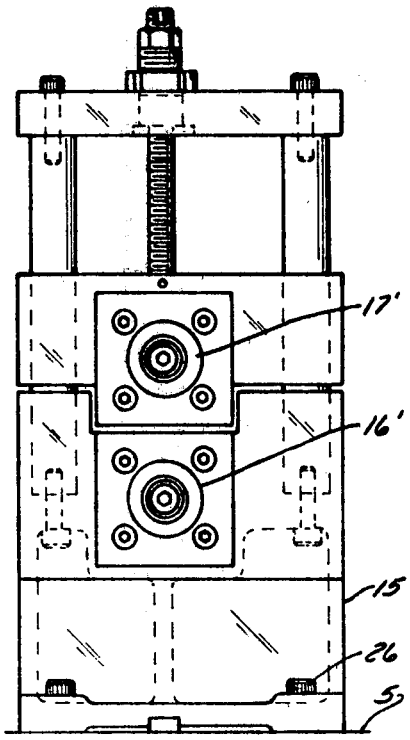
FIG. 5 is a view in elevation of the forming head, as seen from its outer side.
Figure 4:
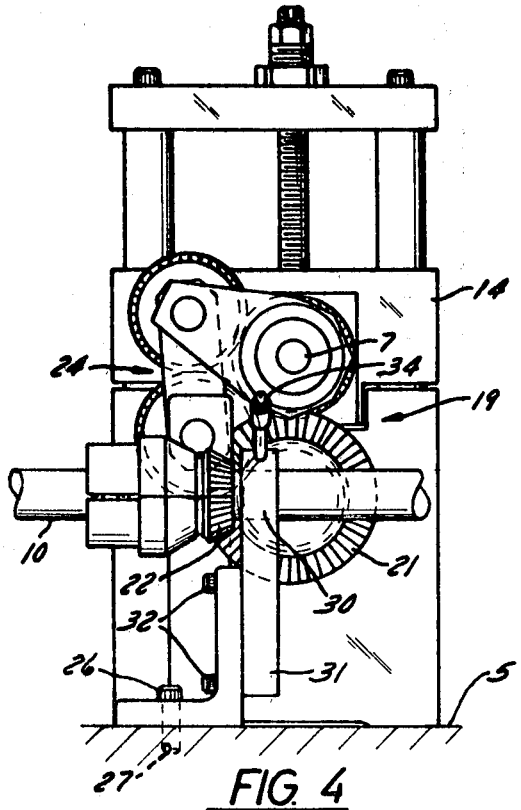
FIG. 4 is a view in elevation of the forming head as seen from the inner or driving side thereof.
Figure 9:
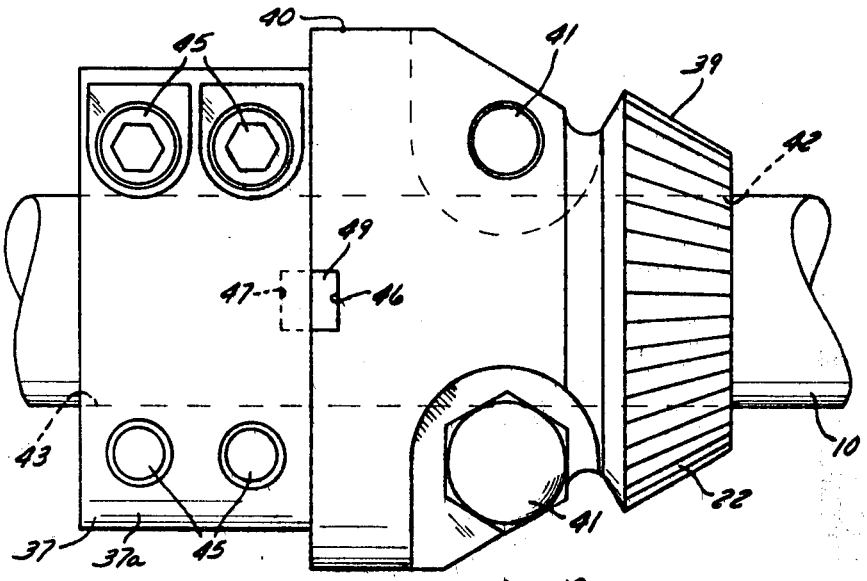
FIG. 9 is a view in side elevation of the bevel pinion in assembled relation to the line shaft.
Figure 10:
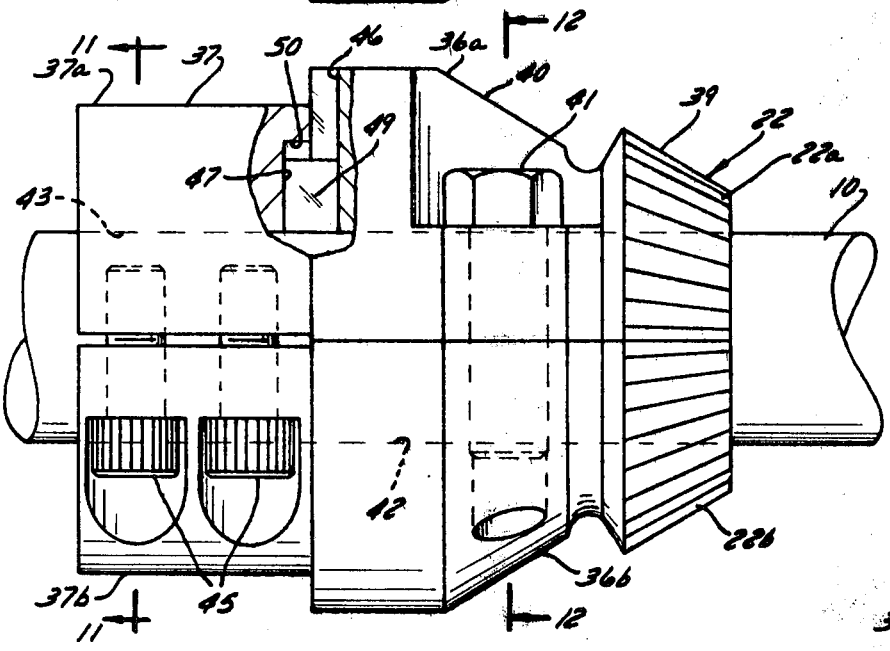
FIG. 10 is another view in elevation of the bevel pinion, but with the pinion rotated 90° from its position shown in FIG. 9 and with a portion broken away and shown in section.
Figure 11:
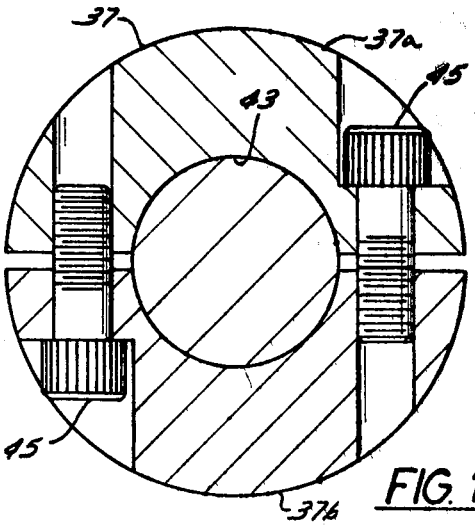
FIG. 11 is a view in section taken on the plane of the line 11—11 in FIG. 10.
Figure 12:
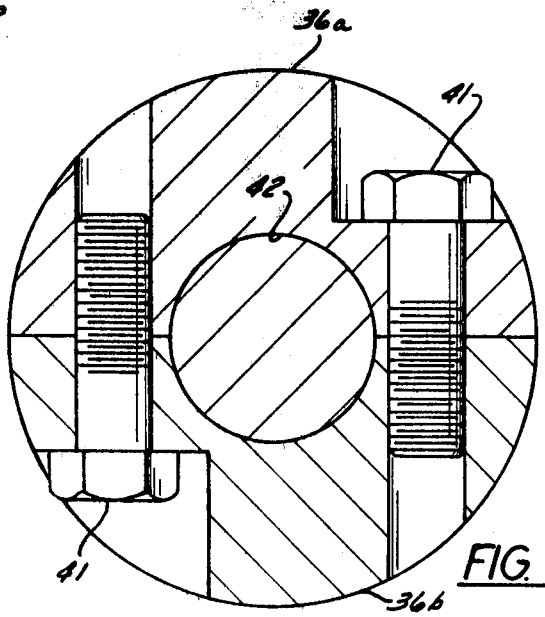
FIG. 12 is a view in section taken on the plane of the line 12—12 in FIG. 10.

A roller forming machine embodying the principles of this invention comprises an elongated, table-like frame 5 and a plurality of forming heads 6 that are mounted on the frame at spaced intervals along its length. Each forming head 6 comprises horizontal and parallel upper and lower roller shafts 7 and 8 that extend across the frame 5 and are rotatable in opposite directions. Coaxially keyed to the shafts 7 and 8 of each forming head are rollers 9, 9' that engage opposite sides of an elongated metal workpiece W to shape it to a desired cross section and move it lengthwise through successive forming heads 6 along the frame. The roller shafts 7, 8 of the several forming heads 6 are driven for their rotation by a line shaft 10 which extends along substantially the full length of the frame 5, at one side thereof, and which is itself rotatably driven by a motor 11.

The line shaft 10 can comprise, as shown, a single long shaft element supported near its opposite ends by bearing supports 12 that are secured to the frame 5. The shaft 10 could obviously comprise two or a few lengths of shaft stock connected end to end, but in any case it preferably has a uniform diameter along substantially its entire length.

Each forming head 6 comprises inner and outer stand members 14 and 15 that support the roller shafts 7, 8 near inner and outer ends thereof, respectively. The inner stand member 14, which is located at the side of the frame 5 along which the line shaft 10 extends, supports transmission means 19 as well as bearings 16 and 17 for the inner ends of the roller shafts 7 and 8. The outer stand member 15, which is located near the opposite side of the frame 5, is essentially only a support for bearings 16', 17' at the outer ends of the roller shafts 7, 8. In a known arrangement, the bearings 16, 16' for the upper roller shaft 7 are adjustable up and down in their respective stand members 14, 15 so that forming rollers 9 of various sizes and shapes can be accommodated in the forming head.

The transmission means 19 on the inner stand member 14, through which the roller shafts 7, 8 are rotatably driven from the line shaft 10, comprises a driven bevel gear 21 that meshes with a bevel pinion 22 on the line shaft. The driven bevel gear 21 can be secured on the inner extremity of the lower roller shaft 8, to drive it directly; and the transmission means 19 can further comprise spur gears on the upper and lower roller shafts cooperating with intermediate spur gears to comprise a gear train 24 through which the upper roller shaft 7 is driven from the lower roller shaft 8. The intermediate gears of the gear train 24 are arranged in a known manner to accommodate the various vertical positions to which the upper roller shaft 7 may be adjusted.

In the present case each of the forming heads 6 is adjustably shiftable to any selected one of a plurality of different locations along the length of the frame 5, to adapt the machine for the requirements of the particular workpiece to be formed and the shape that is to be imparted to the workpiece. For that purpose the inner and outer stand members 14, 15 of each forming head are secured to the frame 5 by means of bolts 26 that extend through base portions of the stand members and are received in threaded holes 27 in the frame. The holes 27 are located at regularly spaced intervals all along the length of the frame, to provide a large number of different locations at which each forming head can be positioned. Typically, the distance between holes 27 is 1½ or 2 inches.

At each forming head, the bevel pinion 22 for the forming head, in transmitting torque to the driven bevel gear 21, imposes upon the line shaft 10 a lateral reaction force that tends to bow that shaft. Such lateral force is resisted by a rigid, upright shaft supporting member 30 on the inner stand member 14 of the forming head, which engages the line shaft just in front of the bevel pinion 22 opposite the driven bevel gear 21. The lower portion 31 of the shaft supporting member 30 is detachably secured to the inner stand member 14, as by means of bolts 32; and its upper portion has a C-shaped bay or cutout 33 which opens toward the driven bevel gear 21 and in which the line shaft 10 has a close rotatable fit. A grease fitting 34 on the shaft supporting member 30 provides for lubrication of its shaft engaging surface.

The shaft supporting member 30 engages the line shaft 10 around about half of its circumference, thus confining it against upward and downward deflection as well as against lateral bowing, but because it does not surround the shaft 10, it can be moved laterally to and from operative relationship to the shaft. Hence, when a forming head 6 is to be shifted to a new location along the frame, its shaft supporting member 30 can be easily removed, whereupon its inner stand member 14 is totally disengaged from the line shaft 10 to facilitate the relocation.

As will appear hereinafter, when a forming head 6 is shifted from one location to another, its bevel pinion 22 can be slid axially along the line shaft 10, if desired, but each bevel pinion 22 can also be wholly removed from the line shaft, quickly, easily and without the need for relative axial shifting. To that end each bevel pinion 22 comprises a pinion member 36 and a coaxial collar member 37, and each of those members, in turn, comprises two complementary parts 36*a*, 36*b* and 37*a*, 37*b*, respectively, which are separable from one another on a plane that contains the axis of the member but which are normally connected by bolts that extend across said plane.

The pinion member 36, when assembled, has a coaxial frustoconical front face 39 on which its teeth are formed, and it has a coaxial rear body portion 40 through which the bolts 41 extend that connect its two parts 36*a*, 36*b*. When assembled, with the bolts 41 securely tightened, the pinion member 36 has a bore 42 therethrough that is of such diameter as to have a slidable fit on the shaft 10.

The collar member 37 clamps to the shaft 10 directly behind the pinion member 36 to maintain the latter in meshing engagement with the driven bevel gear 21 and to transmit shaft rotation to the pinion member 36 through a tongue-and-groove connection that is described hereinafter.

The two parts 36*a*, 36*b* that comprise the pinion member 36 are made from blanks which have abutting flat surfaces on the plane of separation, in which plane the axis of the member is contained.

In making the pinion member 36, the blanks that are to comprise its two parts 36*a*, 36*b* are finished to accurate flatness on their respective surfaces that are to be at the parting plane, and they are drilled and tapped to receive clamping bolts 41 by which they are drawn tightly together with their said flat surfaces engaged. Thus connected, the assembly comprising the two blank parts 36*a*, 36*b* is bored and otherwise worked to form it into the finished pinion member 36. The bevel pinion preferably has an even number of teeth which are so located in relation to its parts 36*a*, 36*b* that the plane of separation lies midway between adjacent teeth at each side of the pinion. Because of its sliding fit on the line shaft 10, the pinion member 36 has the opposing surfaces of its parts 36*a*, 36*b* tightly clamped together when it is in assembled relation to the shaft, so that the regular spacing and configuration of its gear teeth is maintained notwithstanding its being made in two parts.

The collar member 37 is made generally in the same way as the pinion member 36, with its blank parts 37*a*, 37*b* secured together by bolts 45. The concentric bore 43 through the collar member, made before its parts 37*a*, 37*b* are separated, has a diameter very slightly smaller that that of the line shaft 10 (i.e., an interference fit). After the collar assembly is bored, the opposing flat surfaces of the parts 37*a*, 37*b* are taken down to some extent, so that when the parts are re-assembled around the line shaft 10, the bolts 45 for the collar member can be tightened to clamp the parts in a secure frictional connection to the shaft. The preferred way of taking down the opposing surfaces of the parts 37*a*, 37*b* is to make a saw cut through the bored collar assembly on its parting plane, whereupon the width of the saw cut defines the approximate distance between the parts 37*a*, 37*b* when they are in claimed relationship to the shaft 10.

The tongue-and-groove connection between the pinion member 36 and the collar member 37 preferably comprises axially rearwardly opening grooves 46 formed in the rear face of the pinion member and axially forwardly opening grooves 47 formed in the front face of the collar member, together with bar-like keys 49 that are received in the opposing grooves of the respective members. The grooves 46, 47 in each member 36, 37 open from opposite sides of the shaft bore 42, 43 through the member, are elongated radially relative to the member, and have their lengths transverse to the plane of separation of the member. As shown, the grooves 47 in the collar member 37 terminate short of its periphery, to define abutments 50 which limit radially outward displacement of the keys 49. Obviously, the grooves 46 in the pinion member 36 could have a similar configuration.

It will be apparent that a bevel pinion 22 can be shifted from one location to another along the line shaft 10 by merely loosening the clamping bolts 45 of its collar member 37 and sliding its collar and pinion members axially along the shaft. On the other hand, the entire bevel pinion 22 or just its pinion member 36, as desired, can be wholly removed from the line shaft without disturbing any other part of the machine.

From the foregoing description taken with the accompanying drawings it will be apparent that this invention provides a roller forming machine which is less complicated and expensive with respect to its drive mechanism than prior such machines, but which is nevertheless more versatile. More specifically, it can be seen that the invention provides a roller forming machine having forming heads which can be readily shifted to different positions along the frame of the machine and having drive mechanism for the roller shafts of each forming head that permits such relocation of the forming heads to be accomplished quickly and easily.

I claim:

1. A roller forming machine comprising an elongated frame and a plurality of forming heads spaced at intervals along said frame, each forming head comprising a stand that supports a pair of laterally extending roller shafts on which forming rollers are carried and transmission means for rotatably driving said roller shafts, said machine being characterized by:

A. cooperating detachable securement means on said frame and on the stand of at least one forming head for securing said stand to the frame at any selected one of a plurality of locations along the length of the frame;

B. a rotatable line shaft extending lengthwise along one side of the frame past said locations;

C. a driven bevel gear on said one forming head for rotatably driving its roller shafts through its transmission means, said bevel gear having its axis parallel to the axis of the roller shafts; and D. a bevel pinion securable to said line shaft at any selected one of said locations, for transmitting rotation of said line shaft to said driven bevel gear, said bevel pinion comprisng (1) a pinion member having a concentric bore therethrough of a diameter to closely slidably fit said line shaft and having a concentric frustoconical front face on which there are teeth for meshing engagement with teeth on said driven bevel gear, said pinion member comprising (a) two pinion member parts separable from one another on a plane containing the axis of the pinion member and (b) a screw extending across said plane and normally connecting said parts;

(2) a collar member comprising (a) complementary collar parts engageable with the line shaft at opposite sides thereof and which together embrace less than the whole circumference of the line shaft, and (b) screw means normally connecting said collar parts for clamping securement of the collar member to the line shaft rearwardly adjacent to the pinion member; and (3) abutment means on a front of said collar member and on a rear of said pinion member (a) defining opposed eccentric surfaces on the respective members that face substantially circumferentially and (b) providing a connection between said members whereby they are confined substantially only against rotation relative to one another to thus accommodate a range of positions of the collar parts circumferentially relative to one another and radially relative to the axis of the pinion member.

2. The roller forming machine of claim 1, further characterized by:

said pinion member having its teen arranged symmetrically to said plane, with the teeth that are adjacent to said plane, at each side of the pinion member, spaced equal distances to opposite sides of said plane.

3. The roller forming machine of claim 1, further characterized by:

said collar member, when its parts are connected for clamping securement to the line shaft (1) having a bore therethrough of a size to have an interference fit with said line shaft, and (2) said collar parts having opposing flat surfaces which are spaced apart and which are on opposite sides of and parallel to a plane containing the axis of the last mentioned bore.

4. The roller forming machine of claim 3, further characterized by:

said cooperating abutment means being defined by (1) a pair of radially elongated grooves in the rear face of said pinion member and the front face of said collar member, the grooves in each of said members being at opposite sides of the bore therethrough and extending lengthwise perpendicular to said plane between the parts of the member; and (2) a pair of bar-like keys, each received in one of the grooves in each of said members.

5. The roller forming machine of claim 1, further characterized by:

a shaft supporting member detachably secured to the stand of said one forming head and embracing and engaging said line shaft around substantially only half of its circumference, at its side remote from said driven bevel gear, to support lateral forces imposed upon said shaft by reactions to the torque transmitted by the bevel pinion.

6. In a machine having an elongated line shaft which is of uniform diameter along substantially its entire length, drive means for transmitting rotation of said shaft to a driven member which can be fixed at any selected one of a plurality of locations along the length of the shaft and which comprises a driven bevel gear that rotates on an axis transverse to the axis of said shaft, said drive means comprising:

A. a bevel pinion member concentrically and closely slidably surrounding said shaft and having a toothed frustoconical front face meshingly engageable with said driven bevel gear, said pinion member being formed in two parts which are separable on a plane containing its axis and which are detachably secured together by screw means extending across said plane;

B. a collar member clampingly engageable with said shaft rearwardly adjacent to said pinion member to be constrained to rotate with the shaft and to confine the pinion member against axial displacement out of meshing engagement with the driven bevel gear, said collar member comprising a pair of collar parts and screw means by which said collar parts are connected, said collar parts, when in clamped relation to said shaft, defining a concentric bore through said collar member that has an interference fit with said shaft and having opposing flat surfaces that parallel and are spaced to opposite sides of a plane containing the axis of said bore; and C. abutment means on a front of said collar member and on a rear of said pinion member (1) defining opposed eccentric surfaces on the respective members that face substantially circumferentially and (2) providing a connection between said members whereby they are confined substantially only against rotation relative to one another to thus accommodate a range of positions of the collar parts circumferentially relative to one another and radially relative to the axis of the pinion member.

7. The drive means of claim 6, further characterized by:

said abutment means comprising bar-like key means confined in radially elongated slots in opposing, axially facing surfaces of said collar member and said pinion member.

8. A roller forming machine comprising an elongated frame and a plurality of forming heads spaced at intervals along said frame, each forming head comprising a pair of laterally extending roller shafts on which forming rollers are carried, a bevel gear rotatable on an axis parallel to that of said rollar shafts and whereby said roller shafts are rotatably driven, and a stand that supports said roller shafts and bevel gear, said machine being characterized by:

A. cooperating detachable securement means on said frame and on the stand of at least one forming head for securing said stand to the frame at any selected one of a plurality of locations along the length of the frame;

B. a rotatable line shaft extending lengthwise along one side of the frame past said locations and supported in bearings near its opposite ends, said line shaft having a uniform diameter along substantially its entire length between said bearings; and C. a bevel pinion releasably securable to said line shaft at any selected one of said locations, for transmitting rotation of said line shaft to said bevel gear, said bevel pinion comprising (1) a pinion member comprising two pinion parts which are normally connected by screw means and which cooperate to define (a) a front pinion portion having a forwardly facing frustoconical portion on which teeth are formed, (b) a coaxial substantially cylindrical rear portion through which said screw means extend, and (c) a bore extending coaxially through said front and rear portions and having a diameter to closely slidably fit the line shaft, said parts being separable on a plane containing the axis of said bore, (2) a collar member comprising two collar parts which are normally connected by clamping screws and which cooperate to define a collar bore that has an interference fit with the line shaft, said collar parts having opposing parallel surfaces spaced to opposite sides of a plane containing said collar bore, and (3) abutment means on a front of said collar member and on a rear of said pinion member (a) defining opposed eccentric surfaces on the respective members that face substantially circumferentially and (b) providing a connection between said members whereby they are confined substantially only against rotation relative to one another to thus accommodate a range of positions of the collar parts circumferentially relative to one another and radially relative to the axis of the pinion member.

9. The roller forming machine of claim 8, further characterized by:

D. a shaft supporting member detachably secured to the stand of said one forming head and having an arcuate cutout wherein said line shaft is received and which defines a curved surface that engages the line shaft, said member embracing and engaging the line shaft around no more than half its circumference, at its side remote from said bevel gear, to support lateral forces imposed upon the line shaft in reaction to torque transmitted by the bevel pinion but to be disengageable from the line shaft by lateral motion relative to it.

* * * * *